US005473824A

United States Patent [19]

Prehodka

[11] Patent Number: 5,473,824

[45] Date of Patent: Dec. 12, 1995

[54] ROTATING OUTLET FOR HAIR DRYERS

[75] Inventor: Barry V. Prehodka, Ridgefield, Conn.

[73] Assignee: Conair Corporation, Stamford, Conn.

[21] Appl. No.: 215,051

[22] Filed: Mar. 21, 1994

[51] Int. Cl.[6] ..... A45D 20/00

[52] U.S. Cl. ..... 34/97; 392/367; 392/384

[58] Field of Search ..... 34/96, 97, 98, 34/99, 100, 283; 239/383; 392/365, 366, 367, 380, 383, 384, 385

[56] References Cited

U.S. PATENT DOCUMENTS

| | | | |
|---|---|---|---|
| 4,019,260 | 4/1977 | Levy et al. | 34/97 |
| 4,132,360 | 1/1979 | Lee, Jr. | 239/383 |
| 4,295,283 | 10/1981 | Tomaro | 34/97 |
| 4,602,146 | 7/1986 | Barns | 392/384 |
| 4,827,105 | 5/1989 | Brown, Jr. | 34/97 |
| 4,878,620 | 11/1989 | Tarleton | 239/383 |
| 5,054,211 | 10/1991 | Shulman | 34/97 |
| 5,091,630 | 2/1992 | Djuric | 34/97 |
| 5,121,463 | 6/1992 | Yoshihara | 34/97 |
| 5,157,757 | 10/1992 | McDougall | 34/97 |
| 5,161,317 | 11/1992 | McDougall | 34/97 |
| 5,333,787 | 8/1994 | Smith et al. | 34/97 |

FOREIGN PATENT DOCUMENTS

| | | |
|---|---|---|
| 0487932 | 6/1992 | European Pat. Off. . |
| 0487933 | 6/1992 | European Pat. Off. . |

*Primary Examiner*—Denise L. Gromada
*Attorney, Agent, or Firm*—Haynes N. Johnson

[57] ABSTRACT

A rotating outlet for hair dryers is provided causing air exiting from the hair dryer to travel in a circular pattern. A tubular member fits the outlet end of the hair dryer, and has a spider across its outlet end which carries a centrally located pivot. A rotating member is mounted on this pivot and carries vanes cutting across the air stream. The vanes cause the rotating member to rotate. The outlet of the rotating member is at an angle to the axis of the air flow leaving the dryer, and, so, as it rotates, causes the air to move in a circular pattern. This pattern duplicates the pattern provided by the user when she rotates the dryer itself.

7 Claims, 1 Drawing Sheet

ROTATING OUTLET FOR HAIR DRYERS

FIELD OF THE INVENTION

This invention relates to the field of hair dryers, and, in particular, to a rotating outlet for spreading the dryer air over a larger area by rotation of the outlet.

BACKGROUND OF THE INVENTION

Various kinds of air diffusers exist for hair dryers. In general, these diffusers serve primarily to spread the air coming from a dryer outlet over all of a larger area and to soften the strength of the resulting air stream. They do not direct the air to specific areas.

In using hair dryers, women often impart a rotating movement to the dryer. This serves to cover different areas of the hair alternately, but does not dissipate the strength of the air stream. My invention accomplishes this type of air movement for the user, and at the same time provides a visual display of its action so that the user readily knows that this motion is occurring.

BRIEF SUMMARY OF THE INVENTION

This invention provides a rotating outlet which can either be an attachment to the outlet end of a hair dryer or can be built in as part of the dryer air outlet.

A tubular member fits about (or is part of) the outlet end of a hair dryer. This member has a spider across its outlet end which carries a centrally located pivot. A rotating member is mounted on this pivot and has carries vanes cutting across the air stream. The vanes cause the rotating member to rotate. Alternatively, the member can be so angled that the thrust of air against it can cause a rotary moment. The output of the rotating member is at an angle to the axis of the air flow leaving the dryer, and, so, as it rotates, causes the air to move in a circular pattern. This pattern duplicates the pattern provided by the user when she rotates the dryer itself.

DETAILED DESCRIPTION OF THE INVENTION

Figure 1:
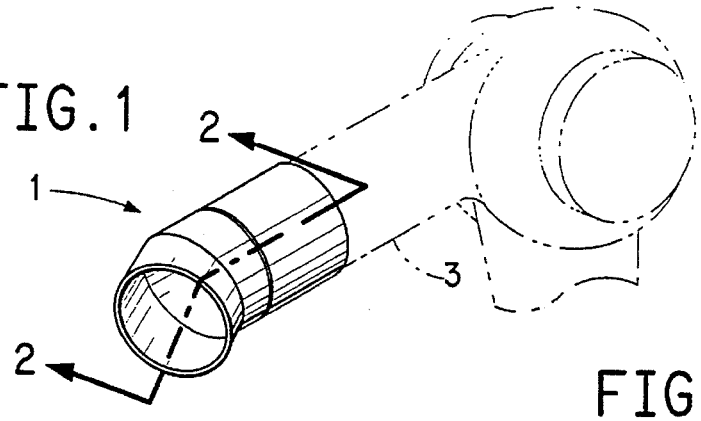
FIG. 1 is a perspective view of my rotary outlet mounted on the outlet of a hair
Figure 3:
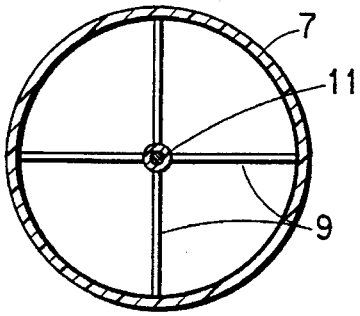
FIG. 3 is a section taken on line 3—3 of FIG. 2.
Figure 2:
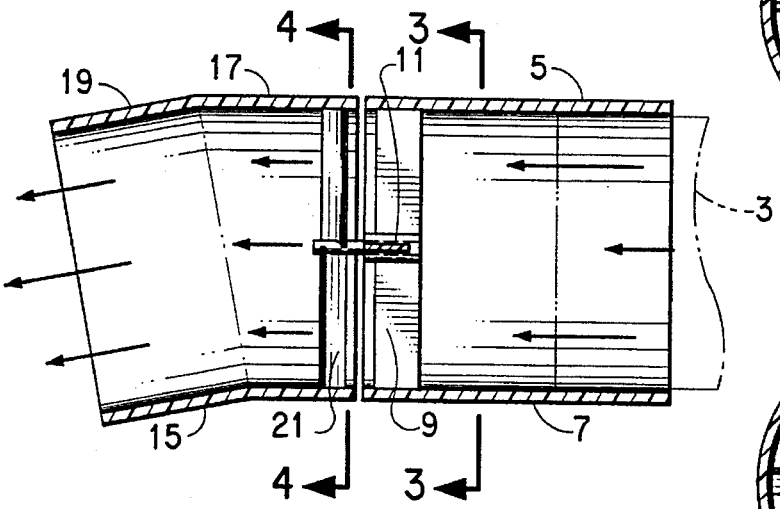
FIG. 2 is a section taken on line 2—2 of FIG. 1.
Figure 4:
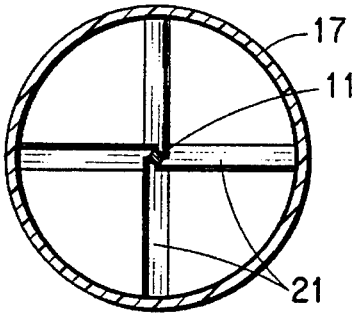
FIG. 4 is a section taken on line 4—4 of FIG. 2
Figure 5:
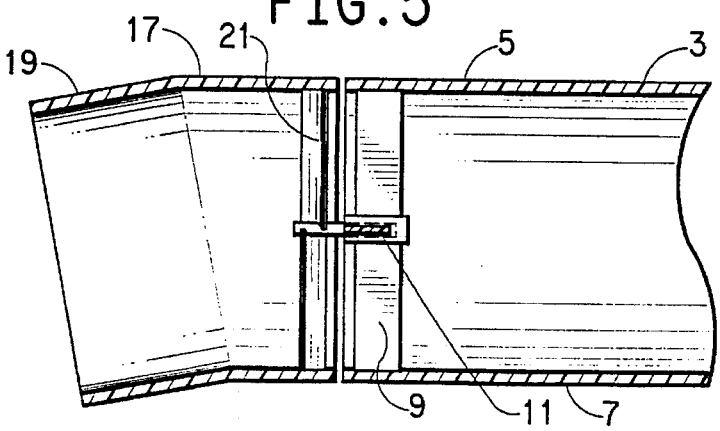
FIG. 5 is a section showing a modification in which the rotary outlet is formed as an integral part of a hair dryer.

FIGS. 1 and 2 show my rotating outlet as an attachment for a hair dryer. FIG. 5 shows it as an integral part of the dryer. FIGS. 3 and 4 show internal construction common to both units.

Rotating outlet 1 is made and dimensioned to fit over the air outlet 3 of a hair dryer. The fit can be of any type, but a simple friction fit works well. The rotary outlet is formed of two parts, a base member 5 and a rotating member 15. These two members are axially aligned and have substantially the same diameters. The upstream end of the base member fits over the dryer outlet.

Base member 5 is a round tube 7 with a spider 9 across its downstream end and a pivot 11 at the center of, and supported by, the spider. The pivot is on the longitudinal axis of the tube.

The rotating member 15 includes a tube 17 having a diameter the same as that of tube 7 and a common longitudinal axis. Tube 17 connects with angled tube 19 and forms the air outlet of the rotating outlet. Rotating member 15 is secured to base member 5 through pivot 11. Thus, member 15 can rotate with respect to tube 7 of the base member.

Rotating member 15 includes a plurality of angled vanes 21 running from the pivot to tube 17. These vanes are in the air stream from the dryer and, so, cause the rotation of the rotating member 15. The result is that angled tube 19 traces a circular pattern and causes the exiting air to flow in a circular path. This produces a rotating pattern of air similar to that achieved by the user rotating the dryer itself. This pattern, however, is not a diffusion resulting in reduced air speed.

The circular pattern followed by the angled tube 19 also has a visual attraction, suggesting to the user the nature of diffusion taking place. In this respect it differs from other diffusers which do not show the resulting air pattern in a manner which can be seen.

The diffuser of FIG. 5 is a permanent part of the dryer. It is the same as the separate diffuser just described except that the base member 5 and the dryer outlet 3 are unitary.

If desired, a locking means can be provided to temporarily prevent rotation. This could take the form of a slot in the rotating member and a slide in the base member, which would move into the slot, or the parts could be reversed.

Means can also be provided to change the angle of the rotating member, such as providing a ball joint on the rotating member.

I claim:

1. A rotating outlet for a hair dryer, said hair dryer providing an air stream and having an air outlet to the atmosphere for said air stream, said rotating outlet including a rotating member, means for pivotally mounting said rotating member proximate to said air outlet and in said air stream, said rotating member including vanes positioned across said air stream to cause rotation of said rotating member, and means for causing said air stream to enter the atmosphere in the form of a column of air moving in a circular pattern as said air stream leaves said rotating outlet, said means including an angled tube integral with and extending from said rotating member whereby said angled tube will rotate with said rotating member, said angled tube being positioned to receive said air stream after it has passed through said rotating member and to release said air stream into the atmosphere in said circular pattern.

2. A rotating outlet for a hair dryer, said hair dryer providing an air stream and having an air outlet to the atmosphere, said rotating outlet including, a base member, said base member including a tubular section having an upstream end and a downstream end, means for securing said tubular section to said air outlet proximate to said upstream end, said base member receiving said air stream in said tubular section, a spider across said tubular section, and a pivot positioned in said spider along the axis of said tubular section, a rotating member positioned proximate to said base member and positioned to receive air from said tubular section, said rotating member being secured to said spider by said pivot, said rotating member including vanes positioned across said air stream to cause rotation of said rotating member, and means for causing said air stream to enter the atmosphere in the form of a column of air moving in a circular pattern as said air stream leaves said rotating outlet, said means including an angled tube integral with and extending from said rotating member whereby said angled tube will rotate with said rotating member, said angled tube being positioned to receive said air stream after it has passed through said rotating member and to release said air stream into the atmosphere in said circular pattern.

3. A rotating outlet as set forth in claim 2 in which said rotating member includes an aligned tube axially aligned with said tubular section, said aligned tube leading to said angled tube, and said aligned tube carrying said vanes.

4. A rotating outlet as set forth in claim 3 in which said tubular section and said aligned tube have substantially the same diameters.

5. A rotating outlet as set forth in claim 2 in which said tubular section is integrally joined to said air outlet, and thereby forms part of said hair dryer.

6. A rotating outlet for a hair dryer, said hair dryer providing an air stream and having an air outlet to the atmosphere, said rotating outlet including, a base member, said base member including a tubular section having an upstream end and a downstream end, means for securing said tubular section to said air outlet proximate to said upstream end, a rotating member pivotally secured to said base member and in alignment therewith, means actuated by said air stream to cause rotation of said rotating member, and means for causing said air stream to enter the atmosphere in the form of a column of air moving in a circular pattern, said means including an angled tube integral with and extending from said rotating member, said angled tube being positioned to receive said air stream after it has passed through said rotating member, whereby rotation of said rotating member will produce said column of air moving in said circular pattern in the atmosphere.

7. A rotating outlet for a hair dryer, said hair dryer providing an air stream and having an air outlet to the atmosphere for said air stream, said rotating outlet including a rotating member, means for pivotally mounting said rotating member in said air stream, said rotating member including means positioned in said air stream to cause rotation of said rotating member, and means for causing said air stream to enter the atmosphere in the form of a column of air moving in a circular pattern as said air stream leaves said rotating outlet, said means including deflecting means integral with and extending from said rotating member whereby said deflecting means will rotate with said rotating member, said deflecting means being shaped to receive said air stream after it has passed through said rotating member and to direct said air stream into the atmosphere in said circular pattern.

* * * * *